US009087627B2

(12) United States Patent
Wu et al.

(10) Patent No.: US 9,087,627 B2
(45) Date of Patent: Jul. 21, 2015

(54) INTERMEDIATE TRANSFER MEMBER AND METHOD OF MANUFACTURE

(71) Applicant: Xerox Corporation, Norwalk, CT (US)

(72) Inventors: Jin Wu, Pittsford, NY (US); Kyle B. Tallman, Farmington, NY (US); Lanhui Zhang, Webster, NY (US); Lin Ma, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 198 days.

(21) Appl. No.: 13/926,398

(22) Filed: Jun. 25, 2013

(65) Prior Publication Data

US 2014/0374664 A1 Dec. 25, 2014

(51) Int. Cl.

| | |
|---|---|
| ***H01B 1/24*** | (2006.01) |
| ***G03G 15/00*** | (2006.01) |
| ***G03G 15/08*** | (2006.01) |
| ***G03G 15/16*** | (2006.01) |

(52) U.S. Cl.

CPC ..... *H01B 1/24* (2013.01); *G03G 15/0818* (2013.01); *G03G 15/162* (2013.01)

(58) Field of Classification Search

CPC ..... H01B 1/04; H01B 1/24; G03G 15/162; G03G 15/0818; G03G 5/105

See application file for complete search history.

(56) References Cited

U.S. PATENT DOCUMENTS

| | | | | |
|---|---|---|---|---|
| 6,072,976 | A * | 6/2000 | Kuriyama et al. | 399/302 |
| 8,829,088 | B1 * | 9/2014 | Wu et al. | 524/140 |
| 8,829,089 | B1 * | 9/2014 | Wu | 524/140 |
| 2012/0208907 | A1 * | 8/2012 | Wu | 521/25 |
| 2012/0244463 | A1 * | 9/2012 | Wu et al. | 430/84 |

OTHER PUBLICATIONS

Zelec UC product bulletin & data sheet (Stepan Co.: stepan.com) Dec. 2012 (2 pages).*

* cited by examiner

*Primary Examiner* — Mark Kopec

(74) *Attorney, Agent, or Firm* — Hoffman Warnick LLC

(57) ABSTRACT

There is described an intermediate transfer member that include a layer of a polyimide polymer, carbon black and an alcohol phosphate. The alcohol phosphate has the structure:

where R is an alkyl having from about 2 to about 36 carbon atoms. A method of manufacturing the intermediate transfer member is provided.

20 Claims, 3 Drawing Sheets

INTERMEDIATE TRANSFER MEMBER AND METHOD OF MANUFACTURE

BACKGROUND

1. Field of Use

This disclosure is directed to an image-forming apparatus and an intermediate transfer member.

2. Background

Image-forming apparatuses in which a color or black and white image is formed by using an intermediate transfer member to electrostatically transfer toner are well known. When an image is formed on a sheet of paper in a color image-forming apparatus using such an intermediate transfer member, four color images in yellow, magenta, cyan and black respectively, are generally first transferred sequentially from an image carrier such as a photoreceptor and superimposed on the intermediate transfer member (the primary transfer). This full color image is then transferred to a sheet of paper in a single step (the secondary transfer). In a black and white image-forming apparatus, a black image is transferred from the photoreceptor, superimposed on an intermediate transfer member, and then transferred to a sheet of paper.

Conductive carbon black usually has a very narrow percolation threshold range. The common logarithm of an intermediate transfer member surface conductivity (Ω/□) is in the range of 8 to 13. Carbon black is a filler in films, both in transfer members and fusers, so its dispersion uniformity and interaction with polymeric resins have significant impact on the performance of these films. In coating solutions, conductive carbon black is dispersed in polymeric binder(s) with organic solvent(s). Due to the high solution viscosity required for coating these belts, the in-situ dispersion of carbon black in a polymeric solution is very difficult. Common problems in current coating processes in intermediate transfer members include non-uniform carbon black dispersion distributions, coating defects and variable conductivity.

There is a need to develop new intermediate transfer member materials processes that are repeatable and provide an acceptable transfer member having suitable properties.

SUMMARY

According to various embodiments, there is provided an intermediate transfer member including a layer of a polyimide polymer, carbon black and an alcohol phosphate. The alcohol phosphate has the structure:

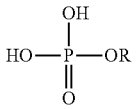

where R is an alkyl having from about 2 to about 36 carbon atoms.

A further aspect disclosed herein is an intermediate transfer member including a substrate layer and a surface layer disposed on the substrate layer. The surface layer includes a polyimide polymer, carbon black and an alcohol phosphate. The alcohol phosphate has the structure:

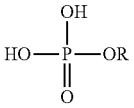

where R is an alkyl having from about 2 to about 36 carbon atoms, wherein the carbon black comprises at least 3 weight percent of the layer disposed on the substrate layer.

A further aspect disclosed herein is A method of making an intermediate transfer member. The method includes dispersing carbon black, an alcohol phosphate and a solvent to form a mixture. The mixture is mixed with polyamic acid to form a polyamic acid mixture. A non-ionic polymeric fluorochemical surfactant is mixed with the polyamic acid mixture to form a dispersion. The dispersion is filtered through a filter having a pore size of from about 10 microns to about 200 microns to form a coating dispersion. The coating dispersion is coated onto a substrate and cured at a temperature of from about 250° C. to about 370° C. for a time of from about 30 to about 180 minutes to form the intermediate transfer member.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts.

In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Figure 1:
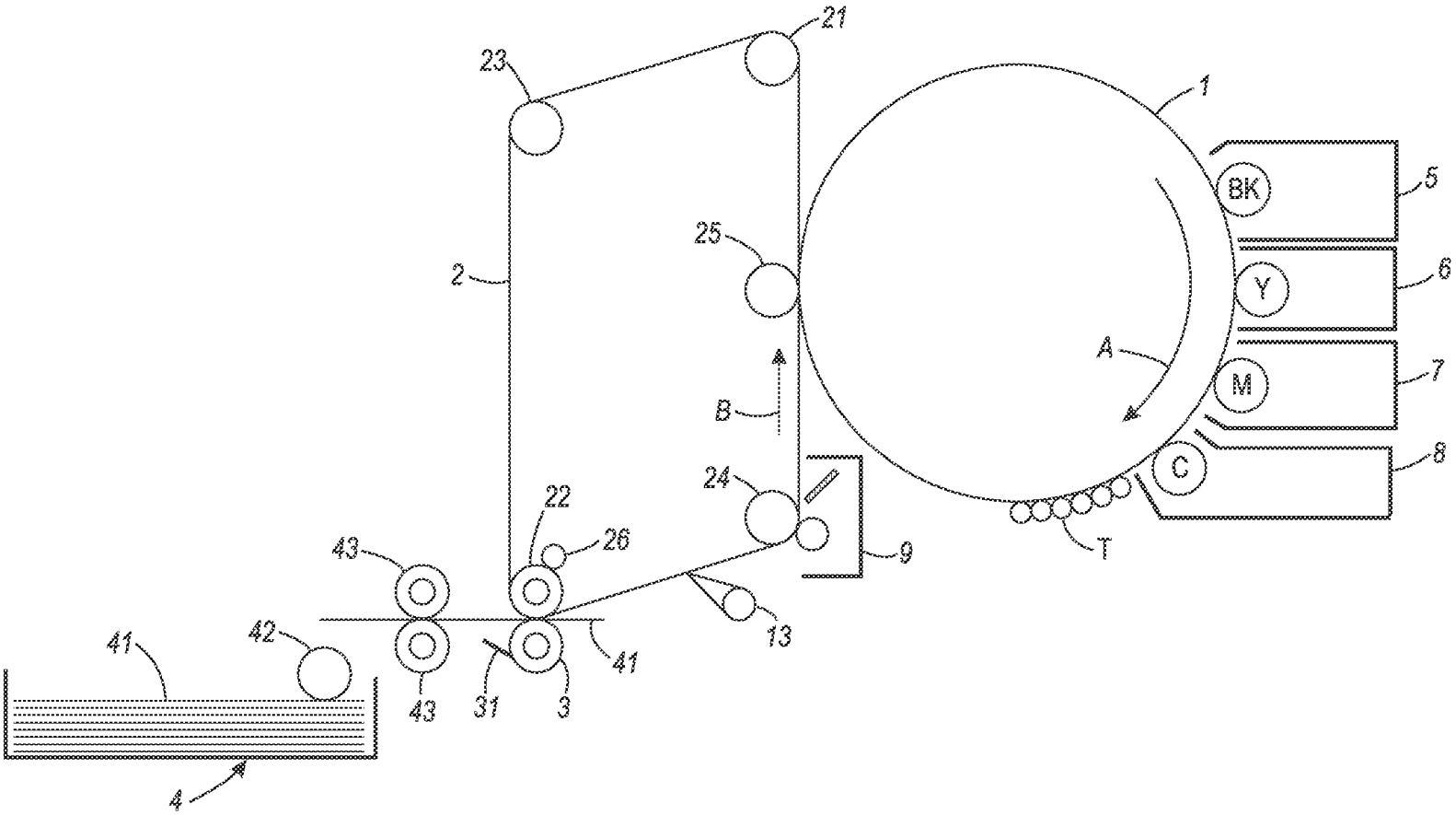
FIG. 1 is a schematic illustration of an image apparatus.

Referring to FIG. 1, an image-forming apparatus includes an intermediate transfer member as described in more detail below. The image-forming apparatus is an image-forming apparatus of an intermediate transfer system comprising a first transfer unit for transferring the toner image formed on the image carrier onto the intermediate transfer member by primary transfer, and a second transfer unit for transferring the toner image transferred on the intermediate transfer member onto the transfer material by secondary transfer. Also in the image-forming apparatus, the intermediate transfer member may be provided as a transfer-conveying member for conveying the transfer material in the transfer region for transferring the toner image onto the transfer material. Having the intermediate transfer member that transfers images of high quality and that remains stable for a long period is required.

The image-forming apparatus described herein is not particularly limited as far as it is an image-forming apparatus of intermediate transfer type, and examples include an ordinary monochromatic image-forming apparatus accommodating only a monochromatic color in the developing device, a color image-forming apparatus for repeating primary transfer of the toner image carried on the image carrier sequentially on the intermediate transfer member, and a tandem color image-forming apparatus having plural image carriers with developing units of each color disposed in series on the intermediate transfer member. More specifically, it may arbitrarily comprise an image carrier, a charging unit for uniformly charging the surface of the image carrier, an exposure unit for exposing the surface of the intermediate transfer member and forming an electrostatic latent image, a developing unit for developing the latent image formed on the surface of the image carrier by using a developing solution and forming a toner image, a fixing unit for fixing the toner unit on the transfer material, a cleaning unit for removing toner and foreign matter sticking to the image carrier, a destaticizing unit for removing the electrostatic latent image left over on the surface of the image carrier, and others by known methods as required.

As the image carrier, a known one may be used. As its photosensitive layer, an organic system, amorphous silicon, or other known material may be used. In the case of the image carrier of cylindrical type, it is obtained by a known method of molding aluminum or aluminum alloy by extrusion, and processing the surface. A belt form image carrier may also used.

The charging unit is not particularly limited, and known chargers may be used, such as a contact type charger using conductive or semiconductive roller, brush, film and rubber blade, scorotron charger or corotron charge making use of corona discharge, and others. Above all, the contact type charging unit is preferred from the viewpoint of excellent, charge compensation capability. The charging unit usually applies DC current to the electrophotographic photosensitive material, but AC current may be further superposed.

The exposure unit is not particularly limited, and, for example, an optical system device may be used, which exposes a desired image on the surface of the electrophotographic photosensitive material by using a light source such as semiconductor laser beam, LED beam, liquid crystal shutter beam or the like, or through a polygonal mirror from such light source.

The developing unit may be properly selected depending on the purpose, and, for example, a known developing unit for developing by using one-pack type developing solution or two-pack type developing solution, with or without contact, using brush and roller may be used.

The first transfer unit includes known transfer chargers such as a contact type transfer charger using member, roller, film and rubber blade, and scorotron transfer charger or corotron transfer charger making use of corona discharge. Above all, the contact type transfer charger provides excellent transfer charge compensation capability. Aside from the transfer charger, a peeling type charger may be also used together.

The second transfer unit may be same as the first transfer unit such as a contact type transfer charger using transfer roller and others, scorotron transfer charger and corotron transfer charger. By pressing firmly by the transfer roller of the contact type transfer charger, the image transfer stage can be maintained. Further, by pressing the transfer roller or the contact type transfer charger at the position of the roller for guiding the intermediate transfer member, the action of moving the toner image from the intermediate transfer member to the transfer material may be done.

As the photo destaticizing unit, for example, a tungsten lamp or LED may be used, and the light quality used in the photo destaticizing process may include white light of tungsten lamp and red light of LED. As the irradiation light intensity in the photo destaticizing process, usually the output is set to be about several times to 30 times of the quantity of light showing the half exposure sensitivity of the electrophotographic photosensitive material.

The fixing unit is not particularly limited, and any known fixing unit may be used, such as heat roller fixing unit and oven fixing unit.

The cleaning unit is not particularly limited, and any known cleaning device may be used.

A color image-forming apparatus for repeating primary transfer is shown schematically in FIG. 1. The image-forming apparatus shown in FIG. 1 includes a photosensitive drum 1 as image carrier, a transfer member 2 as an intermediate transfer member such as a transfer belt, a bias roller 3 as transfer electrode, a tray 4 for feeding paper as transfer material, a developing device 5 by BK (black) toner, a developing device 6 by Y (yellow) toner, a developing device 7 by M (magenta) toner, a developing device 8 by C (cyan) toner, a member cleaner 9, a peeling pawl 13, rollers 21, 23 and 24, a backup roller 22, a conductive roller 25, an electrode roller 26, a cleaning blade 31, a block of paper 41, a pickup roller 42, and a feed roller 43.

In the image-forming apparatus shown in FIG. 1, the photosensitive drum 1 rotates in the direction of arrow A, and the surface of the charging device (not shown) is uniformly charged. On the charged photosensitive drum 1, an electrostatic latent image of a first color (for example, BK) is formed by an image writing device such as a laser writing device. This electrostatic latent image is developed by toner by the developing device 5, and a visible toner image T is formed. The toner image T is brought to the primary transfer unit comprising the conductive roller 25 by rotation of the photosensitive drum 1, and an electric field of reverse polarity is applied to the toner image T from the conductive roller 25. The toner image T is electrostatically adsorbed on the transfer member 2, and the primary transfer is executed by rotation of the transfer member 2 in the direction of arrow B.

Similarly, a toner image of a second color, a toner image of a third color and a toner image of a fourth color are sequentially formed, and overlaid on the transfer member 2, and a multi-layer toner image is formed.

The multi-layer toner image transferred on the transfer member 2 is brought to the secondary transfer unit comprising the bias roller 3 by rotation of the transfer member 2. The secondary transfer unit comprises the bias roller 3 disposed at the surface side carrying the toner image of the transfer member 2, backup roller 22 disposed to face the bias roller 3 from the back side of the transfer member 2, and electrode roller 26 rotating in tight contact with the backup roller 22.

The paper 41 is taken out one by one from the paper block accommodated in the paper tray 4 by means of the pickup roller 42, and is fed into the space between the transfer member 2 and bias roller 3 of the secondary transfer unit by means of the feed roller 43 at a specified timing. The fed paper 41 is conveyed under pressure between the bias roller 3 and backup roller 22, and the toner image carried on the transfer belt 2 is transferred thereon by rotation of the transfer member 2.

The paper 41 on which the toner image is transferred, is peeled off from the transfer member 2 by operating the peeling pawl 13 at the retreat position until the end of primary transfer of the final toner image, and conveyed to the fixing device (not shown). The toner image is fixed by pressing and heating, and a permanent image is formed. After transfer of the multi-layer toner image onto the paper 41, the transfer member 2 is cleaned by the cleaner 9 disposed at the downstream side of the secondary transfer unit to remove the residual toner, and is ready for next transfer. The bias roller 3 is provided so that the cleaning blade 31 made of polyurethane or the like may be always in contact, and toner particles, paper dust and other foreign matter sticking by transfer are removed.

In the case of transfer of a monochromatic image, the toner image T after primary transfer is immediately sent to the secondary transfer process, and is conveyed to the fixing device, but in the case of transfer of multi-color image by combination of plural colors, the rotation of the transfer member 2 and photosensitive drum 1 is synchronized so that the toner images of plural colors may coincide exactly in the primary transfer unit, and deviation of toner images of colors is prevented. In the secondary transfer unit, by applying a voltage of the same polarity (transfer voltage) as the polarity of the toner to the electrode roller 26 tightly contacting with the backup roller 22 disposed oppositely through the bias roller 3 and transfer member 2, the toner image is transferred onto the paper 41 by electrostatic repulsion. Thus, the image is formed.

The intermediate transfer member 2 can be of any suitable configuration. Examples of suitable configurations include a sheet, a film, a web, a foil, a strip, a coil, a cylinder, a drum, an endless mobius strip, a circular disc, a belt including an endless belt, an endless seamed flexible belt, an endless seamless flexible belt, an endless belt having a puzzle cut seam, and the like. In FIG. 1, the transfer member 2 is depicted as a belt.

In an image on image transfer, the color toner images are first deposited on the photoreceptor and all the color toner images are then transferred simultaneously to the intermediate transfer member. In a tandem transfer, the toner image is transferred one color at a time from the photoreceptor to the same area of the intermediate transfer member. Both embodiments are included herein.

Transfer of the developed image from the photoconductive member to the intermediate transfer member and transfer of the image from the intermediate transfer member to the substrate can be by any suitable technique conventionally used in electrophotography, such as corona transfer, pressure transfer, bias transfer, and combinations of those transfer means, and the like.

The intermediate transfer member can be of any suitable configuration. Examples of suitable configurations include a sheet, a film, a web, a foil, a strip, a coil, a cylinder, a drum, an endless strip, a circular disc, a drelt (a cross between a drum and a belt), a belt including an endless belt, an endless seamed flexible belt, and an endless seamed flexible imaging belt.

Figure 2:
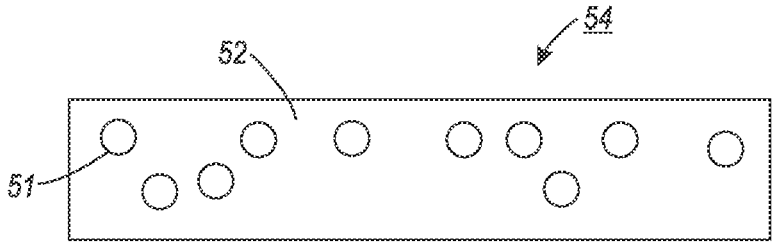
FIG. 2 is a schematic representation of an embodiment disclosed herein.

In an embodiment shown in FIG. 2, the intermediate transfer member 54 is in the form of a film in a one layer configuration. The intermediate transfer member 54 includes a layer 52, wherein the layer includes a polyimide polymer, an alcohol phosphate and carbon black particles 51. The alcohol phosphate has the structure:

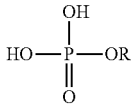

where R is an alkyl having from about 2 to about 36 carbon atoms. The carbon black particles are at least 3 weight percent of the layer.

For high speed machines, the industrial trend is to focus on multi layer members separating layer functions. In an embodiment shown in FIG. 3, the intermediate transfer member 54 is in the form of a film in a two layer configuration. The intermediate transfer member 54 includes a substrate layer 50. The outer layer 52 includes a polyimide polymer, an alcohol phosphate and carbon black particles 51. The alcohol phosphate has the structure:

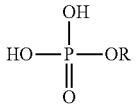

where R is an alkyl having from about 2 to about 36 carbon atoms. The carbon black particles 51 are at least 3 weight percent of the outer layer. Carbon black particles 51 can optionally be provided in the substrate layer 50.

A typical intermediate transfer member composition includes a polyamic acid such as a polyamic acid of pyromellitic dianhydride/4,4-oxydianiline (PYRE® ML RC-5083 from Summit Industrial Technology), or a polyamic acid of biphenyl tetracarboxylic dianhydride/phenylenediamine (BPDA from Kaneka), a carbon black such as channel black such as special black 4 (from Orion), an alkylphenoxy polyethoxyethanol phosphate STEPFAC® 8171 (from Stepan) and a leveling agent Novec™ FC-4432 (from 3M) with the weight ratio of 89/11/1.5/0.1. The resistivity is about $10^{10}$ ohm/sq with about 11% of the carbon black. However, due to the percolation threshold of the carbon black, small variations in loading will push the resistivity out of specification. In addition, the flow coated belt having the above composition shows coating defects. It is theorized the coating defects are caused by the alkylphenoxy polyethoxyethanol phosphate.

To solve the above resistivity sensitivity or percolation issue, a less conductive carbon black such as oil furnace black substituted for the conductive channel black with the same other intermediate transfer member components as above. NEROX® 505 furnace black, also from Orion was used; however, an acceptable dispersion could not be obtained.

In order to provide a good coating dispersion, an alcohol phosphate was substituted for the alkylphenoxy polyethoxyethanol phosphate. It was theorized the alkyl chain of the alcohol phosphate would assist in dispersing carbon black in polyamic acid since there are significantly less organic groups on the surface of the oil furnace carbon black than that of the channel carbon black.

Figure 4:
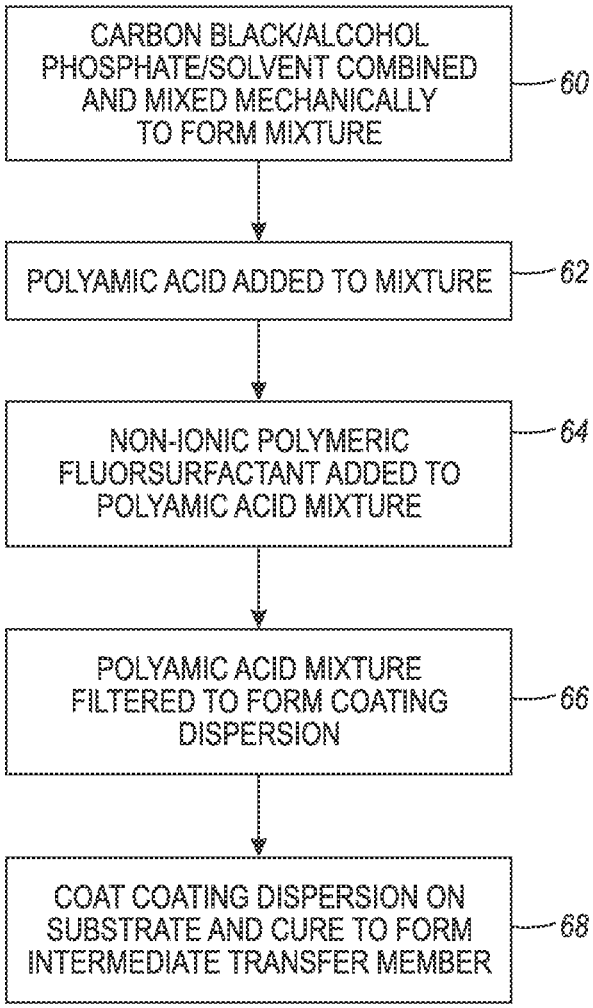
FIG. 4 is a flow chart of a method of an embodiment disclosed herein

The process to make the intermediate transfer member is shown in FIG. 4. Carbon black, and an alcohol phosphate are dispersed and mechanically mixed in a solvent in step 60. Polyamic acid is added to the mixture in step 62. The resulting mixture is balled milled or subjected to other mechanical mixing processes. In step 64, a fluorosurfactant leveling agent is added to the mixture from 62. The mixture in 64 is subjected to mechanical mixing. The mixture in 64 is filtered in step 66. The filter used is a 20 micron filter. In embodiments, the pore size of the filter is from about 10 microns to about 200 microns, or from about 20 microns to about 100 microns. The filtered mixture of step 66 is coated on a substrate and cured in step 68 to form an intermediate transfer member. In embodiments, steps 60 and 62 can be conducted simultaneously.

The disclosed polyamic acid includes one of a polyamic acid of pyromellitic dianhydride/4,4'-oxydianiline, a polyamic acid of pyromellitic dianhydride/phenylenediamine, a polyamic acid of biphenyl tetracarboxylic dianhydride/4,4'-oxydianiline, a polyamic acid of biphenyl tetracarboxylic dianhydride/phenylenediamine, a polyamic acid of benzophenone tetracarboxylic dianhydride/4,4'-oxydianiline, a polyamic acid of benzophenone tetracarboxylic dianhydride/4,4'-oxydianiline/phenylenediamine, and the like and mixtures thereof.

Commercial examples of polyamic acid of pyromellitic dianhydride/4,4-oxydianiline include PYRE-ML RC5019 (about 15-16 weight percent in N-methyl-2-pyrrolidone, NMP), RC5057 (about 14.5-15.5 weight percent in NMP/aromatic hydrocarbon=80/20), and RC5083 (about 18-19 weight percent in NMP/DMAc=15/85), all from Industrial Summit technology Corp., Parlin, N.J.; DURIMIDE® 100, commercially available from FUJIFILM Electronic Materials U.S.A., Inc.

Commercial examples of polyamic acid of biphenyl tetracarboxylic dianhydride/4,4'-oxydianiline include U-VARNISH A, and S (about 20 weight percent in NMP), both from UBE America Inc., New York, N.Y.

Commercial examples of polyamic acid of biphenyl tetracarboxylic dianhydride/phenylenediamine include BPDA resin (about 16.6 weight percent in NMP) from Kaneka Corporation, TX; PI-2610 (about 10.5 weight percent in NMP), and PI-2611 (about 13.5 weight percent in NMP), both from HD MicroSystems, Parlin, N.J.

Commercial examples of polyamic acid of benzophenone tetracarboxylic dianhydride/4,4'-oxydianiline include RP46, and RP50 (about 18 weight percent in NMP), both from Unitech Corp., Hampton, Va.

Commercial examples of polyamic acid of benzophenone tetracarboxylic dianhydride/4,4'-oxydianiline/phenylenediamine include PI-2525 (about 25 weight percent in NMP), PI-2574 (about 25 weight percent in NMP), PI-2555 (about 19 weight percent in NMP/aromatic hydrocarbon=80/20), and PI-2556 (about 15 weight percent in NMP/aromatic hydrocarbon/propylene glycol methyl ether=70/15/15), all from HD MicroSystems, Parlin, N.J.

Various amounts of polyamic acid can be selected for the substrate, such as for example, from about 60 to about 98 weight percent, from 65 to about 90 weight percent, or from 70 to about 85 weight percent.

Other polyamic acid or ester of polyamic acid examples that can be included in the intermediate transfer member are from the reaction of a dianhydride and a diamine. Suitable dianhydrides include aromatic dianhydrides and aromatic tetracarboxylic acid dianhydrides such as, for example, 9,9-bis(trifluoromethyl)xanthene-2,3,6,7-tetracarboxylic acid dianhydride, 2,2-bis(3,4-dicarboxyphenyl)hexafluoropropane dianhydride, 2,2-bis((3,4-dicarboxyphenoxy)phenyl) hexafluoropropane dianhydride, 4,4'-bis(3,4-dicarboxy-2,5,6-trifluorophenoxy)octafluorobiphenyl dianhydride, 3,3',4,4'-tetracarboxybiphenyl dianhydride, 3,3',4,4'-tetracarboxybenzophenone dianhydride, di-(4-(3,4-dicarboxyphenoxy)phenyl)ether dianhydride, di-(4-(3,4-dicarboxyphenoxy)phenyl) sulfide dianhydride, di-(3,4-dicarboxyphenyl)methane dianhydride, di-(3,4-dicarboxyphenyl)ether dianhydride, 1,2,4,5-tetracarboxybenzene dianhydride, 1,2,4-tricarboxybenzene dianhydride, butanetetracarboxylic dianhydride, cyclopentanetetracarboxylic dianhydride, pyromellitic dianhydride, 1,2,3,4-benzenetetracarboxylic dianhydride, 2,3,6,7-naphthalenetetracarboxylic dianhydride, 1,4,5,8-naphthalenetetracarboxylic dianhydride, 1,2,5,6-naphthalenetetracarboxylic dianhydride, 3,4,9,10-perylenetetracarboxylic dianhydride, 2,3,6,7-anthracene tetracarboxylic dianhydride, 1,2,7,8-phenanthrenetetracarboxylic dianhydride, 3,3',4,4'-biphenyltetracarboxylic dianhydride, 2,2',3,3'-biphenyltetracarboxylic dianhydride, 3,3',4-4'-benzophenonetetracarboxylic dianhydride, 2,2',3,3'-benzophenonetetracarboxylic dianhydride, 2,2-bis(3,4-dicarboxyphenyl)propane dianhydride, 2,2-bis(2,3-dicarboxyphenyl)propane dianhydride, bis(3,4-dicarboxyphenyl)ether dianhydride, bis(2,3-dicarboxyphenyl)ether dianhydride, bis(3,4-dicarboxyphenyl)sulfone dianhydride, bis(2,3-dicarboxyphenyl)sulfone 2,2-bis(3,4-dicarboxyphenyl)-1,1,1,3,3,3-hexafluoropropane dianhydride, 2,2-bis(3,4-dicarboxyphenyl)-1,1,1,3,3,3-hexachloropropane dianhydride, 1,1-bis(2,3-dicarboxyphenyl)ethane dianhydride, 1,1-bis(3,4-dicarboxyphenyl)ethane dianhydride, bis(2,3-dicarboxyphenyl)methane dianhydride, bis(3,4-dicarboxyphenyl)methane dianhydride, 4,4'-(p-phenylenedioxy)diphthalic dianhydride, 4,4'-(m-phenylenedioxy) diphthalic dianhydride, 4,4'-diphenylsulfidedioxybis(4-phthalic acid)dianhydride, 4,4'-diphenylsulfonedioxybis(4-phthalic acid)dianhydride, methylenebis(4-phenyleneoxy-4-phthalic acid)dianhydride, ethylidenebis(4-phenyleneoxy-4-phthalic acid)dianhydride, isopropylidenebis-(4-phenyleneoxy-4-phthalic acid)dianhydride, hexafluoroisopropylidenebis(4-phenyleneoxy-4-phthalic acid)dianhydride, and the like. Exemplary diamines suitable for use in the preparation of the polyamic acid include 4,4'-bis-(m-aminophenoxy)-biphenyl, 4,4'-bis-(m-aminophenoxy)-diphenyl sulfide, 4,4'-bis-(m-aminophenoxy)-diphenyl sulfone, 4,4'-bis-(p-aminophenoxy)-benzophenone, 4,4'-bis-(p-aminophenoxy)-diphenyl sulfide, 4,4'-bis-(p-aminophenoxy)-diphenyl sulfone, 4,4'-diamino-azobenzene, 4,4'-diaminobiphenyl, 4,4'-diaminodiphenylsulfone, 4,4'-diamino-p-terphenyl, 1,3-bis-(gamma-aminopropyl)-tetramethyl-disiloxane, 1,6-diaminohexane, 4,4'-diaminodiphenylmethane, 3,3'-diaminodiphenylmethane, 1,3-diaminobenzene, 4,4'-diaminodiphenyl ether, 2,4'-diaminodiphenylether, 3,3'-diaminodiphenylether, 3,4'-diaminodiphenylether, 1,4-diaminobenzene, 4,4'-diamino-2,2',3,3',5,5',6,6'-octafluoro-biphenyl, 4,4'-diamino-2,2',3,3',5,5',6,6'-octafluorodiphenyl ether, bis[4-(3-aminophenoxy)-phenyl]sulfide, bis[4-(3-aminophenoxy)phenyl]sulfone, bis[4-(3-aminophenoxy)phenyl]ketone, 4,4'-bis(3-aminophenoxy)biphenyl, 2,2-bis[4-(3-aminophenoxy)phenyl]-propane, 2,2-bis[4-(3-aminophenoxy)phenyl]-1,1,1,3,3,3-hexafluoropropane, 4,4'-diaminodiphenyl sulfide, 4,4'-diaminodiphenyl ether, 4,4'-diaminodiphenyl sulfone, 4,4'-diaminodiphenylmethane, 1,1-di(p-aminophenyl)ethane, 2,2-di(p-aminophenyl)propane, and 2,2-di(p-aminophenyl)-1,1,1,3,3,3-hexafluoropropane, and the like and mixtures thereof.

The dianhydrides and diamines are, for example, selected in a weight ratio of dianhydride to diamine of from about 20:80 to about 80:20, and more specifically, in an about 50:50 weight ratio. The above aromatic dianhydride like aromatic tetracarboxylic acid dianhydrides and diamines like aromatic diamines are used singly or as a mixture, respectively.

Examples of alcohol phosphates selected as a dispersing agent with the carbon black and an internal release agent with the polyamic acid, such as a polyamic acid of pyromellitic dianhydride/phenylenediamine, include an alcohol phosphate having the structure:

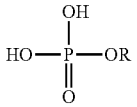

where R is an alkyl having from about 2 to about 36 carbon atoms. Alcohol phosphates are available from Stepan as ZELEC® UN where R is from about 8 to about 10 carbon atoms. Various amounts of the alcohol phosphate can be selected for the layer, such as for example, from about 0.05 to about 20 weight percent, from 0.2 to about 10 weight percent, or from 0.5 to about 5 weight percent.

The conductivity of carbon black is primarily dependent on surface area and its structure, generally, the higher the surface area and the higher the structure, the more conductive the carbon black. Surface area is measured by the B.E.T. nitrogen surface area per unit weight of carbon black, and is the measurement of the primary particle size. The surface area of the carbon black described herein is from about 460 $m^2/g$ to about 35 $m^2/g$. Structure is a complex property that refers to the morphology of the primary aggregates of carbon black. It is a measure of both the number of primary particles comprising primary aggregates, and the manner in which they are "fused" together. High structure carbon blacks are characterized by aggregates comprised of many primary particles with considerable "branching" and "chaining", while low structure carbon blacks are characterized by compact aggregates comprised of fewer primary particles. Structure is measured by dibutyl phthalate (DBP) absorption by the voids within carbon blacks. The higher the structure, the more the voids, and the higher the DBP absorption.

Examples of carbon blacks selected for the intermediate transfer member include VULCAN® carbon blacks, REGAL® carbon blacks, MONARCH® carbon blacks and BLACK PEARLS® carbon blacks available from Cabot Corporation. Specific examples of conductive carbon blacks are BLACK PEARLS® 1000 (B.E.T. surface area=343 $m^2/g$, DBP absorption=1.05 ml/g), BLACK PEARLS® 880 (B.E.T. surface area=240 $m^2/g$, DBP absorption=1.06 ml/g), BLACK PEARLS® 800 (B.E.T. surface area=230 $m^2/g$, DBP absorption=0.68 ml/g), BLACK PEARLS® L (B.E.T. surface area=138 $m^2/g$, DBP absorption=0.61 ml/g), BLACK PEARLS® 570 (B.E.T. surface area=110 $m^2/g$, DBP absorption=1.14 ml/g), BLACK PEARLS® 170 (B.E.T. surface area=35 $m^2/g$, DBP absorption=1.22 ml/g), VULCAN® XC72 (B.E.T. surface area=254 $m^2/g$, DBP absorption=1.76 ml/g), VULCAN® XC72R (fluffy form of VULCAN® XC72), VULCAN® XC605, VULCAN® XC305, REGAL® 660 (B.E.T. surface area=112 $m^2/g$, DBP absorption=0.59 ml/g), REGAL® 400 (B.E.T. surface area=96 $m^2/g$, DBP absorption=0.69 ml/g), REGAL® 330 (B.E.T. surface area=94 $m^2/g$, DBP absorption=0.71 ml/g), MONARCH® 880 (B.E.T. surface area=220 $m^2/g$, DBP absorption=1.05 ml/g, primary particle diameter=16 nanometers), and MONARCH® 1000 (B.E.T. surface area=343 $m^2/g$, DBP absorption=1.05 ml/g, primary particle diameter=16 nanometers); Channel carbon blacks available from Evonik-Degussa; Special Black 4 (B.E.T. surface area=180 $m^2/g$, DBP absorption=1.8 ml/g, primary particle diameter=25 nanometers), Special Black 5 (B.E.T. surface area=240 $m^2/g$, DBP absorption=1.41 ml/g, primary particle diameter=20 nanometers), Color Black FW1 (B.E.T. surface area=320 $m^2/g$, DBP absorption=2.89 ml/g, primary particle diameter=13 nanometers), Color Black FW2 (B.E.T. surface area=460 $m^2/g$, DBP absorption=4.82 ml/g, primary particle diameter=13 nanometers), and Color Black FW200 (B.E.T. surface area=460 $m^2/g$, DBP absorption=4.6 ml/g, primary particle diameter=13 nanometers).

Various amounts of carbon black can be included in the layer of the intermediate transfer member. The amount of carbon black in the layer is from about 3 to about 30 weight percent, or from about 6 to about 25 weight percent, or from about 10 to about 20 weight percent.

Examples of conductive fillers in addition to the carbon black that may optionally be included in the intermediate transfer member include; metal oxides and doped metal oxides, such as tin oxide, antimony dioxide, antimony-doped tin oxide, aluminum doped zinc oxide, titanium dioxide, indium oxide, zinc oxide, indium oxide, indium-doped tin trioxide, and polymers such as polyaniline, polypyrrole and polythiophene, and mixtures thereof.

The intermediate transfer member can include a non-ionic polymeric fluorochemical surfactant as a leveling agent. Such fluorochemical surfactants are commercially available from 3M, under the trade name Novec®, or from Dupont, under the trade name Capstone®. The non-ionic polymeric fluorochemical surfactant is from about 0.01 weight percent to about 5 weight percent, or from about 0.05 to about 2 weight percent, or from about 0.1 to about 0.5 weight percent of the layer.

The intermediate transfer member coating composition includes a solvent. Examples of the solvent selected to form the composition include toluene, hexane, cyclohexane, heptane, tetrahydrofuran, methyl ethyl ketone, methyl isobutyl ketone, N,N'-dimethylformamide, N,N'-dimethylacetamide, N-methyl pyrrolidone (NMP), methylene chloride and the like and mixtures thereof where the solvent is selected, for example, in an amount of from about 70 weight percent to about 95 weight percent, and from 80 weight percent to about 90 weight percent based on the amounts polyimide and alcohol phosphate ester in the coating mixture.

The intermediate transfer member having a layer of a polyimide polymer, carbon black and an alcohol phosphate has a Young's modulus of from about 4,000 to about 10,000, or from 5,000 to about 9,000, or from about 6,000 to about 8,000 MPa; a break strength of from about 80 to about 300, or from about 100 to about 250, or from about 120 to about 200 MPa; and a gloss of about 100 to about 140, or from about 105 to about 135, or from about 110 to about 130.

The outer layer of the intermediate transfer member has a surface resistivity of from about $10^9$ ohms/square to about $10^{13}$ ohms/square, or from about $10^9$ ohms/square to about $10^{12}$ ohms/square, or from about $10^9$ ohms/square to about $10^{11}$ ohms/square.

The thickness of the intermediate transfer member shown in FIG. 2 is from about 30 microns to about 400 microns, or from about 50 microns to about 200 microns, or from about 70 microns to about 150 microns.

Figure 3:
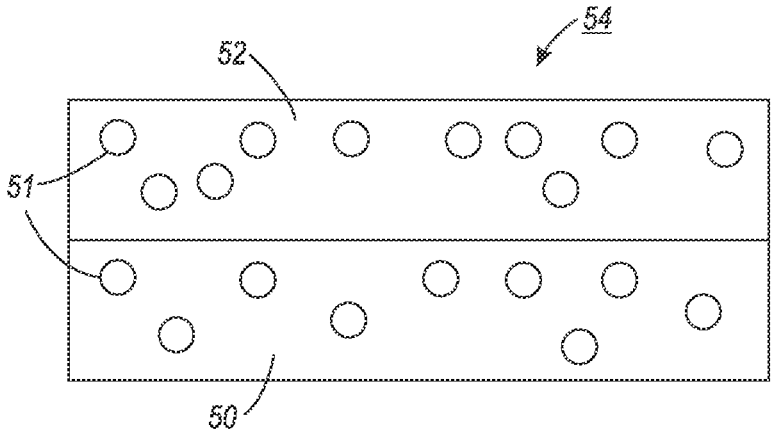
FIG. 3 is a schematic representation of an embodiment disclosed herein.

In FIG. 3, the outer layer thickness is from about 1 micron to about 150 microns, or from about 10 microns to about 100 microns.

After making the dispersion as described in FIG. 4, the dispersion is coated on a substrate such as glass, aluminum, or stainless steel and cured for a single layer. The cured layer is separated from the substrate. In embodiments where a dual or multi-layer intermediate transfer member is desired the dispersion as described in FIG. 4 is coated on a substrate such as polyimide, polyamideimide or polyetherimide and cured.

The dispersion is coated on the substrate layer in any suitable known manner. Typical techniques for coating such materials on the substrate layer include flow coating, liquid spray coating, dip coating, wire wound rod coating, fluidized bed coating, powder coating, electrostatic spraying, sonic spraying, blade coating, molding, laminating, and the like.

The intermediate transfer member layer thickness can be achieved by single pass or multi pass coating. In embodiments, the dispersion from FIG. 4 is coated, and pre-cured at a temperature between about 125° C. and about 190° C. for a time of about 30 to about 90 minutes, and then fully cured at a temperature between about 250° C. and about 370° C. for a time of about 30 to about 90 minutes. In embodiments, the coated dispersion is fully cured at a temperature between about 250° C. and about 370° C. for a time of about 30 to about 180 minutes. In an embodiment a stainless steel belt is used as the substrate. The substrate is rotated at a speed of from about 20 rpm to about 100 rpm during the thermal curing of the coating. The coated dispersion from FIG. 4 stays on the coating substrate all the time during the curing process.

Specific embodiments will now be described in detail. These examples are intended to be illustrative, and not limited to the materials, conditions, or process parameters set forth in these embodiments. All parts are percentages by solid weight unless otherwise indicated.

EXAMPLES

Example 1

A coating dispersion including a polyamic acid of pyromellitic dianhydride/4,4-oxydianiline (PYRE® ML RC-5083), an oil furnace carbon black (NEROX® 505), an alcohol phosphate (ZELEC® UN) and a leveling agent (Novec™ FC-4432) with the weight ratio of 85/15/1.5/0.1 in DMAc/NMP was prepared. The oil furnace carbon black and the alcohol phosphate were dispersed in NMP and mechanically mixed. Polyamic acid was added to carbon black/alcohol phosphate/NMP mixture and ball milled. The leveling agent was added to the ball milled mixture and filter through a 20 micron pore size filter.

Example 2

In Example 2, the same components as Example 1 were used. The carbon black, alcohol phosphate, polyamic acid and solvent were ball milled in one pot. The leveling agent was then added and the dispersion was through a 20 micron pore size filter.

Example 3

In Example 3, the same components as Example 1 were used. The carbon black, polyamic acid and solvent were ball milled in one pot. The alcohol phosphate was added to the ball milled mixture. The leveling agent was then added and the dispersion was through a 20 micron pore size filter.

The dispersion prepared in Example 1 was readily filtered through a 20 micron Nylon cloth filter. In contrast, the dispersion prepared Example 2 was very slowly filtered through the same 20 micron Nylon cloth filter. In Example 3, the majority of the dispersion did not pass through the 20 micron Nylon cloth filter. The CB particle size of the filtered portion was measured using a MALVERN HPPS5001 dynamic light scattering instrument, and the results are shown in Table 1.

TABLE 1

| | Carbon Black Particle Size (nm) |
|---|---|
| Example 1 (readily filtered dispersion tested) | 72 |
| Example 2 (very slowly filtered dispersion tested) | 81 |
| Example 3 (only the filtered small portion tested) | 97 |

Example 1 produced the best dispersion quality with the smallest carbon black particle size. The dispersion readily passed through the 20 micron filter. The alcohol phosphate release agent/dispersing agent had the opportunity to cover the carbon black surface without any perturbation from polyamic acid in Example 1. Example 2 and 3 both showed irregularities in filtering which can lead to coating irregularities in the intermediate transfer member.

Example 4

A coating dispersion was prepared similarly with alkylphenoxy polyethoxyethanol phosphate (Stepfac 8171) instead of the alcohol phosphate as in Example 1. The majority of the dispersion did not go through the 20 micron Nylon cloth filter. The CB particle size of the filtered portion was measured using a MALVERN HPPS5001 dynamic light scattering instrument, and the results are shown in Table 2.

TABLE 2

| | Carbon Black Particle Size (nm) |
|---|---|
| Example 1: NEROX ® 505 with alcohol phosphate dispersion (all the dispersion went through the filter and was tested.) | 72 |
| Example 4: NEROX ® 505 with alkylphenoxy polyethoxyethanol phosphate dispersion (only the small portion that went through the filter was tested.) | 75 |

The carbon black particle sizes of the filtered portions of the two dispersions were similar; however, the dispersion with the alcohol phosphate went through the filter readily; whereas majority of the controlled dispersion with the alkylphenoxy polyethoxyethanol phosphate did not go through the filter. In conclusion, the dispersion using alcohol phosphate produced a coating mixture with smaller carbon black particles.

The dispersion of Example 1 was flow coated, and cured. The resulting belt exhibited desired resistivity (about $5\times10^{10}$ ohm/sq), excellent mechanical properties (Young's modulus=4,200 MPa and Break strength=120 MPa), and a gloss of about 120, which properties are comparable to those of FX's Chamonix intermediate transfer member.

In addition, the belt had substantially no coating defects. The previously observed uncharacteristic coating defects from the alkylphenoxy polyethoxyethanol phosphate belt were not observed in the disclosed alcohol phosphate belt.

In summary, the disclosed alcohol phosphate as an intermediate transfer member component not only serves as an internal release agent to release the cured belt from the coating substrate, but also serves as an excellent dispersing agent for carbon black, especially that with little organic groups on the surface. The resulting intermediate transfer member dispersion can be flow coated with substantially no coating defects.

Other embodiments of the present teachings will be apparent to those skilled in the art from consideration of the specification and practice of the present teachings disclosed herein.

It is intended that the specification and examples be considered as exemplary only, with a true scope and spirit of the present teachings being indicated by the following claims.

What is claimed is:

1. An intermediate transfer member comprising:

a layer comprising a polyimide polymer, carbon black and an alcohol phosphate having the structure:

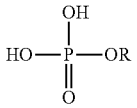

where R is an alkyl having from about 2 to about 36 carbon atoms.

2. The intermediate transfer member of claim 1, wherein the layer further comprises a non-ionic polymeric fluorochemical surfactant.

3. The intermediate transfer member of claim 2, wherein the non-ionic polymeric fluorochemical surfactant comprises from about 0.01 weight percent to about 5 weight percent of the layer.

4. The intermediate transfer member of claim 1, wherein the alcohol phosphate comprises from about 0.05 weight percent to about 20 weight percent of the layer.

5. The intermediate transfer member of claim 1, wherein the layer has a surface resistivity of from about $10^9$ ohms/square to about $10^{13}$ ohms/square.

6. The intermediate transfer member of claim 1, wherein the layer has a thickness of from about 30 microns to about 400 microns.

7. The intermediate transfer member of claim 1, wherein the carbon black comprises from about 3 weight percent to about 30 weight percent of the layer.

8. An intermediate transfer member comprising:

a substrate layer; and a surface layer disposed on the substrate layer, the surface layer comprising a polyimide polymer, carbon black and an alcohol phosphate having the structure:

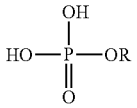

where R is an alkyl having from about 2 to about 36 carbon atoms, wherein the carbon black comprises at least 3 weight percent of the layer disposed on the substrate layer.

9. The intermediate transfer member of claim 8, wherein the surface layer further comprises a non-ionic polymeric fluorochemical surfactant.

10. The intermediate transfer member of claim 9, wherein the non-ionic polymeric fluorochemical surfactant comprises from about 0.01 weight percent to about 5 weight percent of the surface layer.

11. The intermediate transfer member of claim 8, wherein the alcohol phosphate comprises from about 0.05 weight percent to about 20 weight percent of the surface layer.

12. The intermediate transfer member of claim 8, wherein the surface layer has a surface resistivity of from about $10^9$ ohms/square to about $10^{13}$ ohms/square.

13. The intermediate transfer member of claim 8, wherein the surface layer has a thickness of from about 1 micron to about 150 microns.

14. The intermediate transfer member of claim 8, wherein the substrate layer is selected from the group consisting of: polyimide, polyamideimide and polyetherimide.

15. A method of making an intermediate transfer member, the method comprising:

dispersing carbon black, and alcohol phosphate and a solvent to form a mixture;

mixing polyamic acid with the mixture to form a polyamic acid mixture;

mixing a non-ionic polymeric fluorochemical surfactant with the polyamic acid mixture to form a dispersion;

filtering the dispersion through a filter having a pore size of from about 10 microns to about 200 microns to form a coating dispersion;

coating the coating dispersion onto a substrate;

curing the coating at a temperature of from about 250° C. to about 370° C. for a time of from about 30 minutes to about 180 minutes to form the intermediate transfer member.

16. The method of claim 15, wherein the solvent is selected from the group consisting of: tetrahydrofuran, methyl ethyl ketone, methyl isobutyl ketone, N,N'-dimethylformamide, N,N'-dimethylacetamide, N-methylpyrrolidone and methylene chloride.

17. The method of claim 16, wherein the solvent comprises from about 70 weight percent to about 95 weight percent of the coating dispersion.

18. The method of claim 15, wherein the substrate is selected from the group consisting of, glass, aluminum and stainless steel.

19. The method of claim 15 wherein, the alcohol phosphate has the structure:

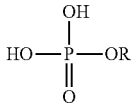

where R is an alkyl having from about 2 carbon atoms to about 36 carbon atoms.

20. The method of claim 15, wherein the carbon black comprises from about 3 weight percent to about 30 weight percent of the intermediate transfer member.

* * * * *